US005749761A

United States Patent [19]

Kim

[11] Patent Number: 5,749,761

[45] Date of Patent: May 12, 1998

[54] MODEL GLIDER HAVING TWIN PROPELLERS

[75] Inventor: Cho-kwon Kim, Kwachon, Rep. of Korea

[73] Assignee: Kang-hee Hahn, Seoul, Rep. of Korea

[21] Appl. No.: 741,132

[22] Filed: Oct. 31, 1996

[30] Foreign Application Priority Data

Oct. 31, 1995 [KR] Rep. of Korea ..... 95-31826

[51] Int. Cl.[6] ..... A63H 27/00

[52] U.S. Cl. ..... 446/60; 446/44

[58] Field of Search ..... 446/44, 59, 60, 446/459, 232; 244/13, 44, 60

[56] References Cited

U.S. PATENT DOCUMENTS

| | | | |
|---|---|---|---|
| 1,060,273 | 4/1913 | Melott | 244/13 |
| 1,399,667 | 12/1921 | Sladek | 446/459 |
| 1,928,154 | 9/1933 | Hojnowski | 446/44 |
| 2,042,715 | 6/1936 | Hunt | 446/60 |
| 2,414,765 | 1/1947 | Platt | 244/60 |
| 3,474,566 | 10/1969 | Cagan et al. | 446/459 |

FOREIGN PATENT DOCUMENTS

| | | | |
|---|---|---|---|
| 2915151 | 10/1979 | Germany | 446/60 |
| 354859 | 2/1938 | Italy | 446/60 |
| 468192 | 6/1937 | United Kingdom | 446/232 |

*Primary Examiner*—Max Hindenburg
*Assistant Examiner*—Laura Fossum
*Attorney, Agent, or Firm*—Van Cott, Bagley, Cornwall & McCarthy

[57] ABSTRACT

The present invention relates to a model glider having twin propellers, which includes a central frame which forms a body of the glider, a vertical tail and a pair of horizontal tails respectively provided on the rear part of the body, a pair of main wings horizontally provided on the middle part of the body, a rotating member, a power transmitting part, an elastic band member, a stopper, a driving part to rotate the twin propellers, and a link lever, wherein the elastic band member is elastically twisted by the rotation of the link lever and while the elastic band member is restored, its rotary power is transmitted to the propellers via the transmitting part and the driving part, so that the model glider has strong propulsive force by means of the twin propellers to increase gliding distance and user' interest.

3 Claims, 4 Drawing Sheets

MODEL GLIDER HAVING TWIN PROPELLERS

BACKGROUND

1. The Field of the Invention

The present invention relates to a model glider having twin propellers which provides strong propulsive force by means of the twin propellers respectively formed in front of main wings of the glider and provides extended gliding distance in a gliding state similar to the real one.

2. The Background Art

A glider is an aircraft like an airplane except that it has no engine and is carried along by air currents. These days, model gliders are widely used as model planes and miniature toys for the purpose of education and play.

The model gliders are distributed and sold in the market in an assembled or disassembled state, and in the latter case the user puts the parts of the model glider together and completes the whole model glider.

The conventional model glider comprises a central frame constituting the body of the model glider, a vertical tail mounted upward on the rear part of the central frame, horizontal tails extended from both side ends of the central frame, and main horizontal wings extended from both sides in the middle parts of the central frame.

As is generally known, the main horizontal wings are to lift the whole body of the model glider and to control the movement of the body of the model glider right and left. The horizontal tails are to control the movement of the body up and down, and the vertical tail is to determine the right and left progressive directions of the body.

Conventionally, the model glider flies using propulsive force caused by the throwing power of a user. However, it has disadvantages that the glider is liable to lose its balance and to fall easily when the user throws it with relatively strong power, and the gliding distance becomes reduced when the user throws it with relatively weak power.

Further, an elastic band member such as a rubber band has been proposed to provide propulsive force to the model glider, wherein the elastic band member is twisted artificially before gliding and untied by its restoring force during the gliding to rotate a single propeller provided in the front center of the model glider. However, this method has also disadvantages that the single propeller can not provide sufficient propulsive force to the model glider to have a flying curve similar to the real plane, causing the glider to fall easily.

BRIEF SUMMARY AND OBJECTS OF THE INVENTION

The object of the present invention is, therefore, to provide a model glider having twin propellers to provide long gliding distance and excellent gliding performance.

According to the present invention, the model glider comprises a central frame which forms a body of the glider; a vertical tail mounted on the rear part of the body; a pair of horizontal tails respectively provided on both sides of the rear part of the body; a pair of main wings horizontally provided on both sides of the middle part of the body; a rotating member fixed at is one end in a hole formed through the central frame of the body; a power transmitting part having a main gear and an auxiliary gear which are engaged with each other and arranged in the front part of the body; an elastic band member having one end connected with the other end of the rotating member and the other end connected to an axis of the main gear, thus the elastic band member being twisted by the rotation of the rotating member and restored by its restoring force; a stopper fixed at a predetermined position on the body at its one end and located on the main gear at the other end thereof to interrupt the rotation of the main gear; a driving part comprising twin propellers respectively formed in front of the main wings, a first pulley mounted coaxially with the auxiliary gear via a connecting member, a pair of pulleys respectively mounted coaxially with the twin propellers, and connecting belts which connect the first pulley with the pair of pulleys to rotate the propellers by the rotatory power due to the restoring force of the elastic band member; and a link lever provided in the rear part of the body and connected to the rotation member at its one end, wherein the elastic band member is elastically twisted by the rotation of the link lever and while the elastic band member is restored, its rotary power is transmitted to the propellers via the transmitting part and the driving part.

BRIEF DESCRIPTION OF THE DRAWINGS

The invention will now be described by way of example with reference to the accompanying drawings, in which.

DETAILED DESCRIPTION OF THE PREFERRED EMBODIMENTS

Figure 1:
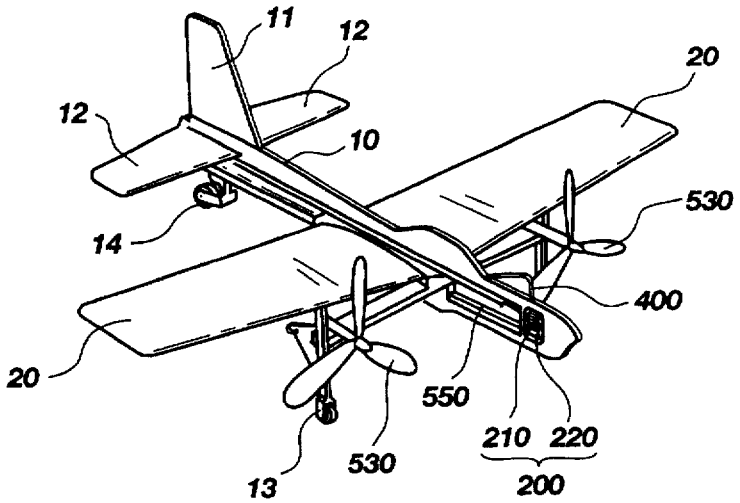
FIG. 1 is a perspective view of a model glider according to the present invention.
Figure 2:
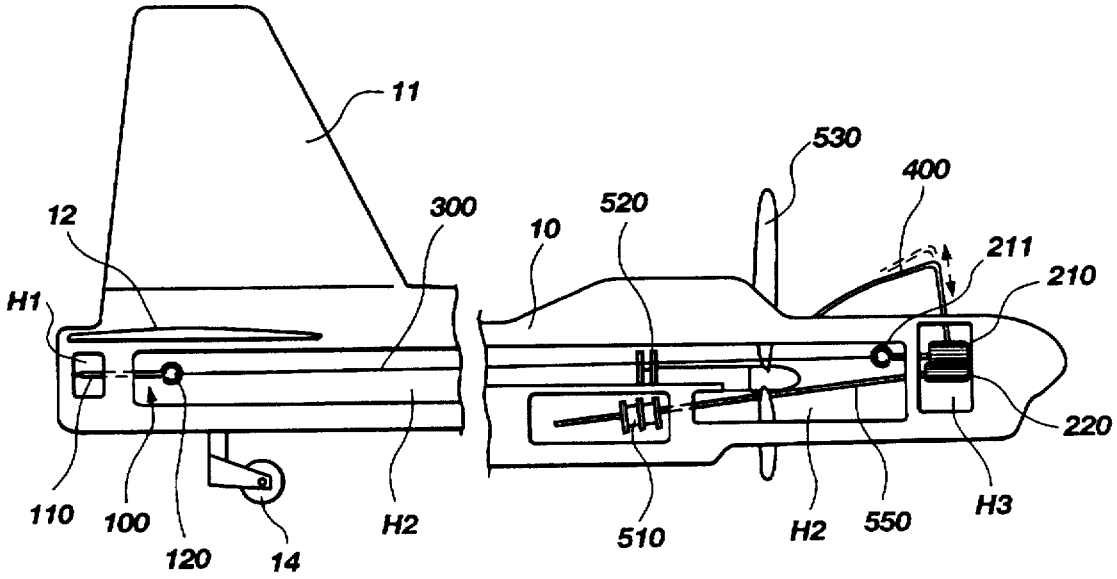
FIG. 2 is a partial longitudinal sectional view of the model glider according to the present invention.

Referring to FIG. 1 and FIG. 2, a model glider having twin propellers according to the present invention includes a central frame constituting a body 10 of the model glider, a vertical tail 11 mounted on a rear part of the body 10, a pair of horizontal tails 12 respectively connected to both sides of the rear part of the body 10, and a pair of main wings 20 connected to both sides of the middle part of the body 10.

The frame of the body 10 is formed to have a predetermined width and thickness and is preferably made of synthetic resin or wood which have relatively light weight and excellent plasticity.

The vertical tail 11, the horizontal tails 12 and the main wings 20 are also preferably made of synthetic resin or wood having relatively light weight and covered with thin sheet. The sheet may be made of paper or vinyl, and paper is more preferable since it has good adhesive and printing properties and provides better flying.

Figure 3:
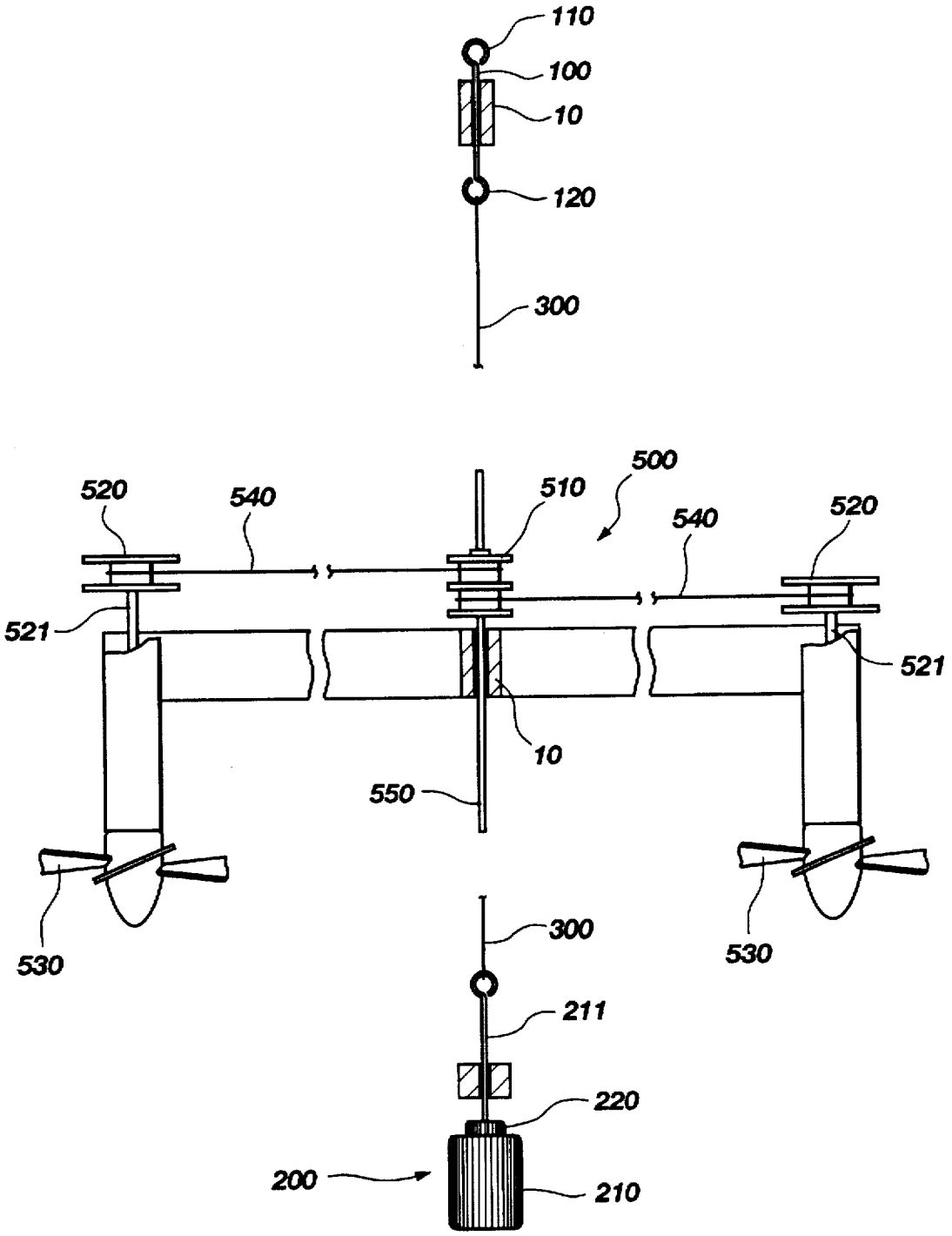
FIG. 3 is a top view of principal parts of the model glider according to the present invention.

Referring to FIG. 2 and FIG. 3, a rotating member 100 is fixed in a first hole Hi formed in the rear part of the body 10 at its one end and connected with a link lever 600 at the other end thereof to twist an elastic band member 300 by the rotation of the link lever 600. More specifically, the rotating member 100 has rings 110 and 120 formed at both ends thereof, of which one ring 120 is connected with one end of the elastic band member 300 and the other ring 110 is connected with the link lever 600, so that if the link lever 600 is rotated manually the elastic band 300 is twisted.

Referring to FIG. 3, a power transmitting part 200 comprises a main gear 210, an auxiliary gear 220 which are engaged with each other and arranged in a third hole H3, and a driving part 500 comprises a pulley 510, a pair of pulleys 520 and connecting belts 540. As the elastic band member 300 which has been twisted by the rotation of the link lever 600 is restored, the main gear 210 and the auxiliary gear 220 engaged with each other rotate consecutively, and the pulley 510 which is coaxially connected with the auxiliary gear 220 via a connecting member 550 rotates in response to the rotation of the auxiliary gear 220.

The main gear 210 is connected with one end of the elastic band member 300 via its axis 211 so that the main gear 210 rotates by the restoring force of the twisted elastic band member 300. The auxiliary gear 220 engaged with the main gear 210 rotates in response to the rotation of the main gear 210, thereby driving the pulley 510 via the connecting member 550.

The elastic band member 300 is located in a second hole H2 which is formed longitudinally in the body 10 as shown in FIG. 2, and twisted by the rotation of the rotating member 100, rotating the main gear 210 via the axis 211 by its restoring force.

In more detail, one end of the elastic band member 300 is connected to the ring 120 of the rotating member 100 and the other end is connected with the axis 211 of the main gear 210.

Figure 4:
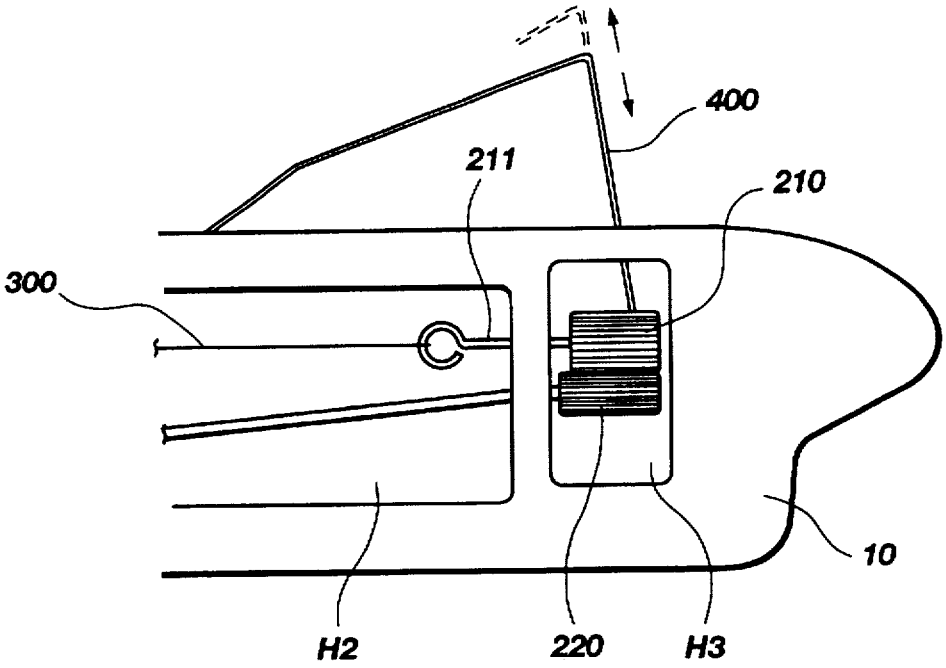
FIG. 4 is a cross-sectional view of the front part of the model glider according to the present invention.
Figure 5:
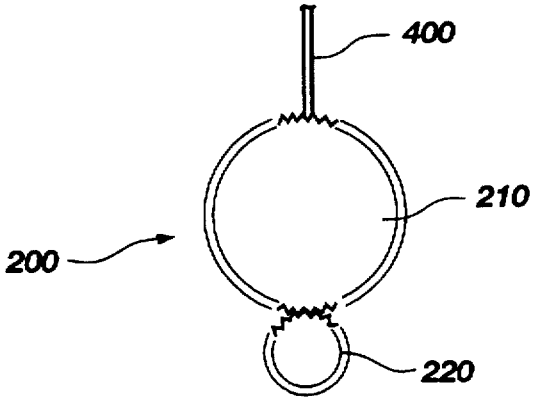
FIG. 5 is a view showing a stopper which interrupts the rotation of the main gear of the model glider according to the present invention.

In this case, the restoring operation of the elastic band member 300 which is twisted by rotating the link lever 600 manually is interrupted by a stopper 400. The stopper 400 is located in the front part of the body 10 and made of steel wire. The stopper 400 has two end parts, of which a first end part is fixed on a predetermined position in the front part of the body 10 and a second one is located among the teeth of the main gear 210 to interrupt the rotation of the main gear 210, thus controlling the restoring operation of the elastic band member 300 as shown in FIGS. 2 and 4.

Therefore, when the second end part of the stopper 400 is departed from the main gear 210, the main gear 210 can rotate in response to the restoring operation of the elastic band member 300, wherein the stopper 400 can be departed from the main gear 210 elastically when the user presses the main gear 210 for a moment. The elastic detachment of the stopper 400 becomes possible since the stopper 400 is made of steel wire having elasticity.

When the stopper 400 is separated from the main gear 210, driving power is supplied from the elastic band member 300 to twin propellers 530 which are rotatably mounted in front of the main wings 20, thereby the model glider flying forward.

If the model glider stops flying since the propulsive force is not supplied any more, the second end of the stopper 400 is pressed by the user onto the main gear 210. When the main gear 210 stops, the link lever 600 is manually rotated to twist the elastic band member 300, thus providing propulsive force.

The driving part 500 drives the twin propellers 530 by the restoring operation of the elastic band member 300. The twin propellers 530 are mounted in front of the main wings 20 and connected to their respective pulleys 520 via power transmitting members 521. The pulleys 520 are connected via connecting belts 540 with the pulley 510 which is connected to the auxiliary gear 220 via the connecting member 550.

The transmitting members 521 may be shafts made of synthetic resin and metal and having a small diameter. The connecting member 550 may be a shaft made of synthetic resin, metal or rubber band and having a small diameter. As for the connecting belts 540, rubber band or wire may be adopted.

Figure 6A:
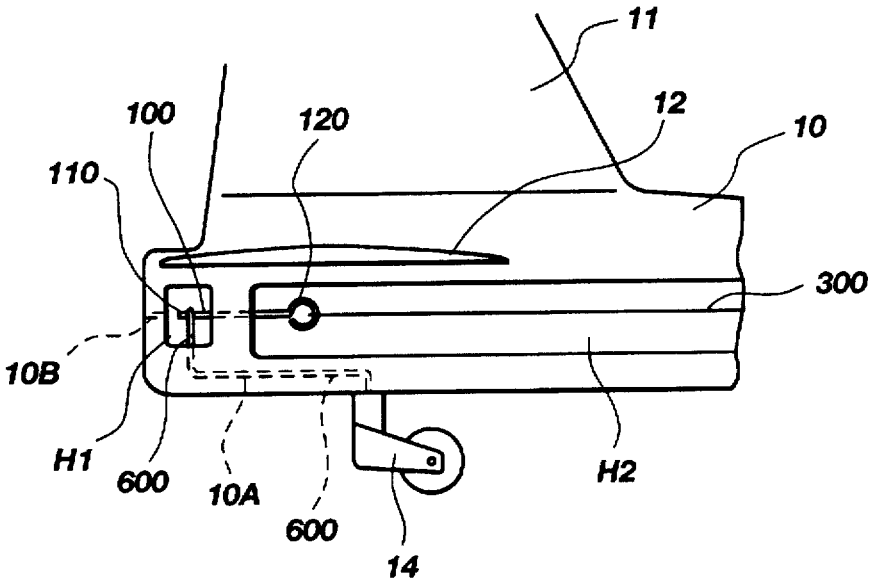
FIGS. 6A and 6B are views respectively showing the rear part of the model glider according to the present invention.
Figure 6B:
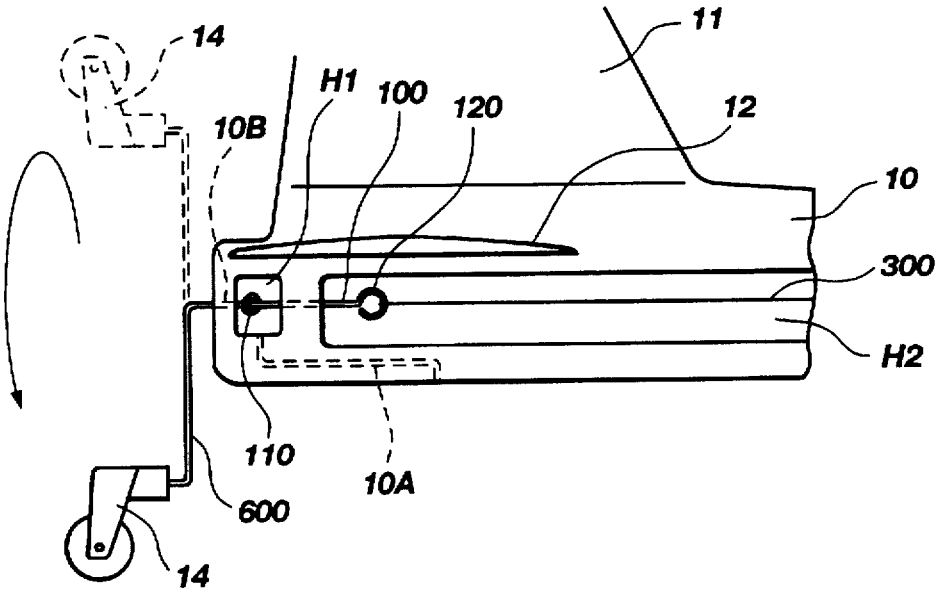

Referring to FIGS. 6A and 6B, the link lever 600 is preferably connected to a retractable stern wheel 14 in the shape of stairs and detachably inserted in a groove 10A formed in the body 10. Further, a groove 10B is formed in the rear part of the body 10 having a diameter of which size is complementary with the link lever 600.

In more detail, the retractable stern wheel 14 is departed from its fixed position when the link lever 600 inserted into the groove 10A is manually pulled out. Then, the stern wheel 14 is removed substantially at a right angle and a part of the link lever 600 is inserted into the groove 10B in the body 10.

As the stern wheel 14 is rotated in one direction, the rotating member 100 is driven to rotate accordingly, twisting the elastic bend member 300. The stern wheel 14 is returned to its original position in the body 10 after the twisting operation of the elastic band member 300 is completed.

Meanwhile, retractable nose landing wheels 13 may be respectively provided under the body 10 or the main wings 20 and the retractable stern wheel 14 may be provided under the rear part of the body 10 so that the model glider can be smoothly and safely landed on the ground without frictional resistance, thus preventing damage of the model glider due to the belly landing.

As described above, the model glider according to the present invention has strong propulsive force by means of the twin propellers to increase gliding distance and users' interest.

Those skilled in the art will readily recognize that these and various other modifications and changes may be made to the present invention without strictly following the exemplary application illustrated and described herein and without departing from the true spirit and scope of the present invention, which is set forth in the following claims.

What is claimed and desired to be secured by U.S. Letters Patent is:

1. A model glider comprising:

a central frame which forms a body of the glider;

a vertical tail mounted on a rear part of the body;

a pair of horizontal tails respectively provided on both sides of the rear part of the body;

a pair of main wings horizontally provided on both sides of a middle part of the body;

a rotating member having a first and second end, the first end is fixed in a hole formed through the central frame of the body;

a power transmitting part having a main gear and an auxiliary gear which are engaged with each other and arranged in a front part of the body;

an elastic band member having a first end connected with the second end of the rotating member and a second end coaxially connected to the main gear, wherein the elastic band member is twisted by the rotation of the rotating member and restored by its restoring force;

a stopper having one end fixed at a predetermined position on the body and another end located on the main gear configured to interrupt the rotation of the main gear;

a driving part comprising twin propellers respectively formed in front of the main wings, a first pulley mounted coaxially with the auxiliary gear via a connecting members a pair of pulleys respectively mounted coaxially with the twin propellers, and connecting belts which connect the first pulley with the pair of pulleys configured to rotate the propellers by restoring force of the elastic band member; and a link lever provided in the rear part of the body and an having one end connected to the rotating member for twisting the elastic band.

2. A model glider according to claim 1, wherein a retractable stern wheel is connected to a second end of the link lever.

3. A model glider according to claim 2, wherein the body has two grooves in its rear part which are at a right angle to each other arranged to receive the link lever therein.

* * * * *